United States Patent [19]

Eichenauer

[11] 4,250,580

[45] Feb. 17, 1981

[54] TRAVEL CRIB

[76] Inventor: Larry L. Eichenauer, 16210 Spinnaker Dr., Crosby, Tex. 77532

[21] Appl. No.: 51,012

[22] Filed: Jun. 22, 1979

[51] Int. Cl.[3] ..... A47D 7/00; A47D 13/06

[52] U.S. Cl. ..... 5/93 R; 229/34 R; 312/258

[58] Field of Search ..... 5/93, 94; 229/34 R, 229/41 B, 43; 206/387, 445, 449; 312/244, 258

[56] References Cited

U.S. PATENT DOCUMENTS

| | | | |
|---|---|---|---|
| 2,128,341 | 8/1938 | Zalkind | 229/34 R |
| 3,276,662 | 10/1966 | Farquhar | 229/43 |
| 3,487,479 | 1/1970 | Grooms | 5/93 R |
| 3,531,041 | 9/1970 | Rohde | 229/34 R |
| 3,654,645 | 4/1972 | Lee | 5/93 R |
| 3,973,674 | 10/1976 | Postlethwaite | 206/449 |

*Primary Examiner*—Casmir A. Nunberg
*Attorney, Agent, or Firm*—Gunn, Lee & Jackson

[57] ABSTRACT

A collapsible, foldable travel crib is disclosed. The illustrated and preferred embodiment is comprised of a single sheet of stiff board which is folded and perforated in a manner to be described to assemble into an open top, generally rectangular crib. It incorporates a set of edge stiffeners having a U-shaped cross section. In the assembled state, the stiffeners are fastened along the top edge to define a straight top edge gaining reinforcing from the stiffeners. In the folded state, the stiffeners are placed along the edge to close the apparatus into a folded, flat body which is easily carried.

7 Claims, 5 Drawing Figures

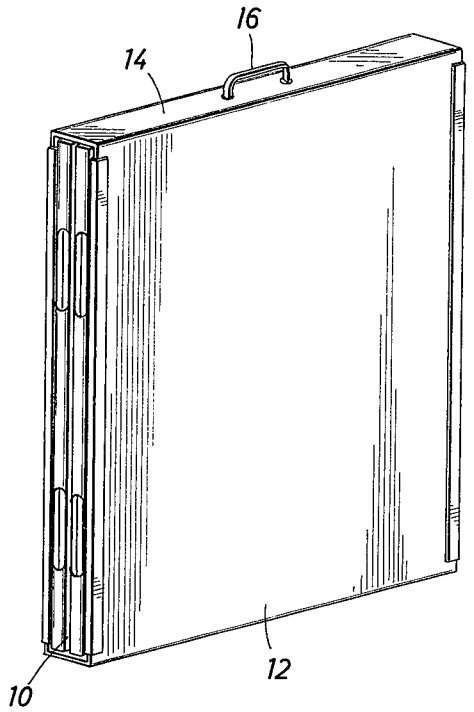
FIG. 1
FIG. 2
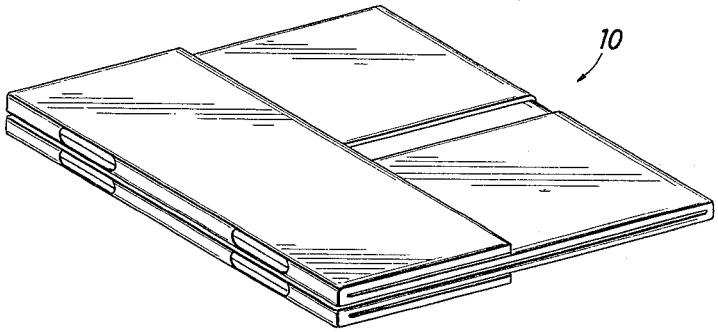
FIG. 3
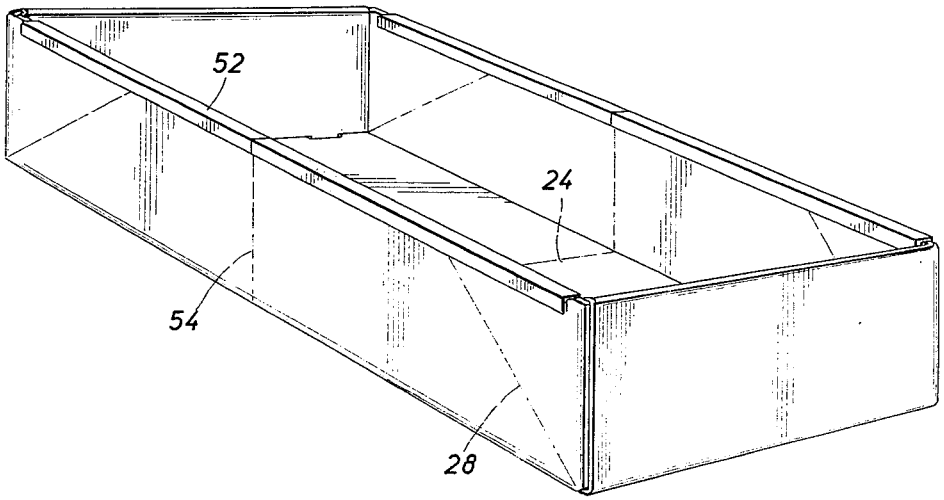

TRAVEL CRIB

BACKGROUND OF THE DISCLOSURE

In automobiles, vans and other vehicles, it is awkward to carry a baby for any distance. In particular, infants in the age range of about three to nine months are able to crawl, but not quite able to stand, and are subject to some risk unless otherwise held or placed in some type of infant seat. There is no particular problem on a short trip; however, on a long trip, the patience of the travelers is sorely tested as the infant becomes more active. An extremely active infant needs a place to crawl without excessive confinement as provided by an infant seat.

Many people travel with young infants and toddlers placed in the back seat of an automobile. They try, using luggage, blankets and other materials, to pad the floor area so that a crawl space is defined on the back seat. While this is more or less successful, it poses some problems in terms of safety. An alternate solution is to position and unfold a portable crib in the back seat area. This, too, has its problems. Generally speaking, a crib is a permanent fixture of significant cost in comparison with the present invention and, more importantly, is a more rigid structure with some degree of risk entailed in its use.

The present invention is a travel crib of an entirely different construction. It provides a softer and more resilient surface than a folding wooden frame crib. Moreover, it is more convenient to handle and carry in the folded state in comparison with baskets made of a metal framework with canvas sides and bottom. The present invention thus provides a relatively safe crib of relatively inexpensive construction which, after usage, can easily be discarded. The crib can be used at motels, in motor homes and at the homes of friends and relatives without cribs. The crib is large enough for a child up to the age of two.

BRIEF DESCRIPTION OF THE DISCLOSURE

This disclosure is directed to an apparatus which assembles into two forms, one being a folded and compacted form and the other being a fully deployed travel crib.

In the folded arrangement, the travel crib is folded into a relatively thin package which suitably slips into a folder or packet of relatively thin construction for the purpose of holding the travel crib. It can be conveniently provided with a pliable handle. In addition, it unfolds to form a large, rectangular bottom with surrounding, upright walls on four sides. The walls are reinforced across the ends and along the top edge of the lengthwise walls for strengthening. The unfolded version can be used for an indefinite period of time, and, after use, it can be refolded and again carried in a convenient manner.

BRIEF DESCRIPTION OF THE DRAWINGS

FIG. 1 shows in perspective view the travel crib of the present invention in a slotted carrier;

FIG. 2 shows the travel crib separate from the carrier prior to unfolding and erection into the deployed form;

FIG. 3 shows the travel crib in the fully deployed and erected position;

DETAILED DESCRIPTION OF THE ILLUSTRATED EMBODIMENT

Figure 4:
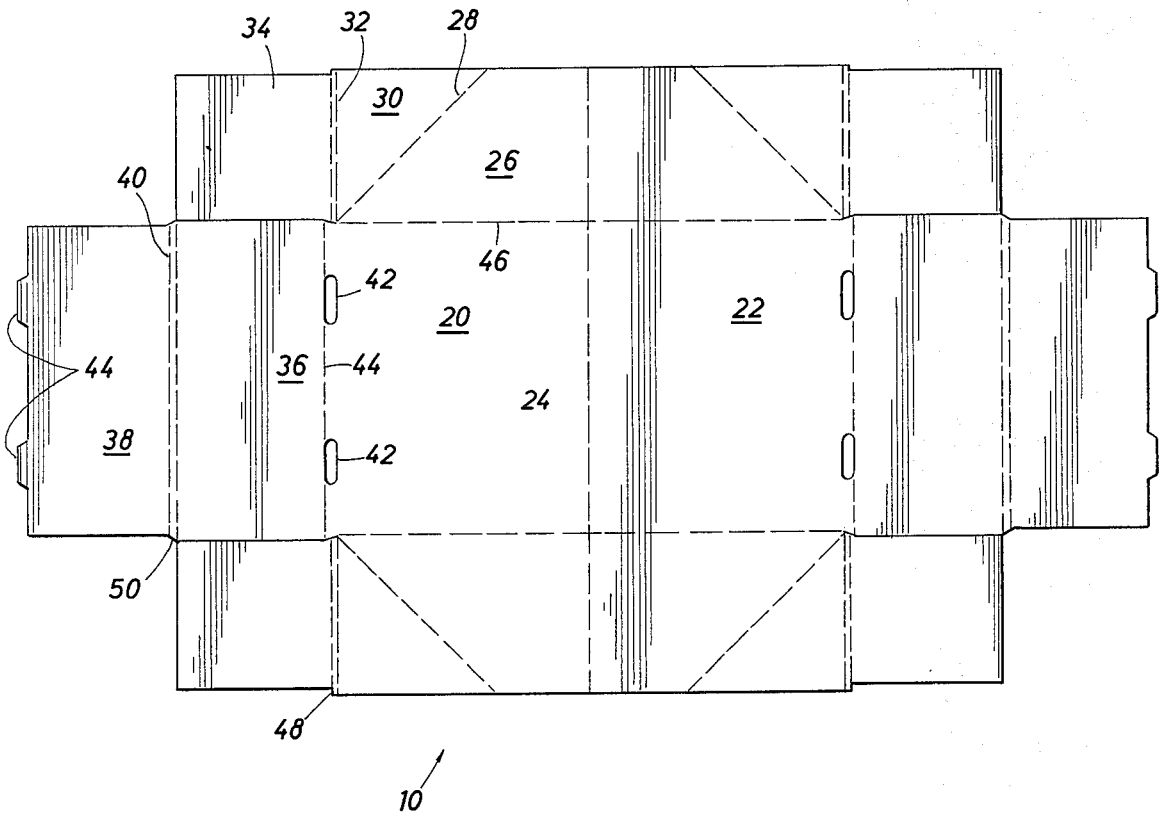
FIG. 4 shows a blank sheet of stiff board with fold marks and cuts which assist in fabrication of the device.

Attention is first directed to FIGS. 1 and 2 of the drawings. In FIG. 2, the infant crib is generally identified by the numeral 10. It is also shown in FIG. 1; however, it is enclosed in a travel case 12. The travel case 12 is hollow and rectangular, being comprised of a pair of sidewalls which are joined by a top piece 14, and the top piece supports a flexible handle 16 to enable it to be lifted. When viewed from the side, the carrier 12 is hollow, having an internal rectangular storage cavity which is open at two ends so that the travel crib 10 can be placed in it. The travel crib 10 is shown in the folded state in FIG. 2.

For a better understanding of the travel crib, it is perhaps best to begin with FIG. 4, showing the blank of material which is cut, perforated, scored and otherwise shaped into the travel crib. The travel crib is comprised of a central bottom made of two square portions 20 and 22. They fold along the line 24 which is in the form of a machine formed crease dividing the two portions 20 and 22. The two portions 20 and 22 are symmetrical. Indeed, on the right and left of the score line 24, the equipment is completely symmetrical. It is also symmetrical along the centerline axis of the length of FIG. 4. The description will be made primarily to the left of the centerline and can be extended to the right side in view of the symmetrical construction. The bottom portion 20 is the surface which supports the infant and is adapted to be rested on a car seat, floor or bed. Moreover, it is confined within walls which are erected around it. The numeral 26 identifies an upstanding sidewall. The term "sidewall" is applied to the walls which are adjacent to the long dimension of the assembled travel crib. End walls span the shorter dimension of the travel crib. The sidewall 26 is, therefore, coextensive in length to the bottom and is scored or prefolded along the line 28 extending at an angle. This defines a triangular portion 30.

The portions 26 and 30 together have a specified height to extend above the bottom 20, and they have a length approximately equal to the length of the bottom portion 20. The difference in length is slight, being determined primarily by a pair of adjacent score or crease marks at 32. The two crease marks define a specified width and isolate a flap 34. The flap 34 is affixed to the remaining portions of the sheet of stock at the double crease mark 32. The manner in which it is folded will be described hereinafter.

As will be recalled, there is a sidewall which is similar in construction along the opposite side. Because it is so similar, it will not be specifically described except to note its incorporation in the structure and to further note that the two sidewall portions are constructed as a mirror image, one to the other.

The numeral 36 identifies a first end wall. The numeral 38 identifies an attached end wall. The walls 36 and 38 are attached to one another at a double fold (sometimes called a shoulder) 40, the double fold again comprising a pair of parallel creases formed in the stock. The first end wall 36 will eventually be on the outside, and the second end wall 38 will fold over to the inside of the assembled travel crib. The two end wall portions, when folded together, define a slot or cavity between them for insertion of the end flap 34; that is to say, the dual fold 40 enables the pair of end walls 36 and 38 to catch and hold the flap 34, locking the sidewall to the end wall at the time of assembly.

The bottom 20 includes a pair of relatively narrow slots 42 which are cut in it at the fold line 44. The slots are in the bottom and immediately at the edge of the bottom portion. The slots 42 align with lock tabs 44 which insert into the slots and extend through the slots for locking the end wall in a U-shaped fold. The U-shaped fold which is achieved at the time of assembly enables the apparatus to be put together and locked until disassembly is required. More importantly, when the lock tabs 44 insert into the slots 42, they extend into it by sufficient depth to prevent accidental disengagement.

The assembly of the travel crib occurs in the following manner. First of all, the sidewall 26 is folded to an upright position relative to the bottom portion 20. This fold is accomplished along the line 46 which accommodates a ninety degree fold. Once the sidewall is upright, the end flap 34 is bent ninety degrees which positions the end flap 34 parallel to the nearer slot 42 and just above it. It obscures the slot only partially, the slot 42 still being exposed for subsequent use. The end wall 36 is then folded to an upright position where it is mutually perpendicular to the bottom 20 and the sidewall 26. At this juncture, the second end wall portion 38 extends above the first end wall portion. The end wall portion 38 is then folded back toward the bottom 20, two folds being formed at the double crease line 40. The two folds carry the lock tabs 44 toward the slots 42, and the lock tabs 44 are inserted into the slots 42 for locking purposes. By this maneuver, the flap 34 is captured between the end wall portions 36 and 38, anchoring the assembled end wall to the sidewall. On review of FIG. 4, it will be observed that the two sidewalls terminate in four end-located flaps similar to the flap 34. The two end walls fold over to define two slots or grooves and, thus, receive the four tabs, thereby locking the sidewalls to the end walls. This defines the walls around the bottom portion 20. Preferably, the walls stand to a uniform height. To accomplish erection of the walls to a uniform height, there is an indention 48 in each end-located lock flap 34. There is a further indention 50 which defines the second end wall portion 38 to a reduced width in comparison with the first.

The device is thus assembled in the foregoing manner. Assembly is accomplished in relatively easy fashion by first folding the sidewalls upright. The end-located flaps 34 are bent at ninety degrees as a second assembly step. Thereafter, the end walls 36 are folded up and then folded again at the double crease 40. The tabs 44 are then inserted by pushing or stabbing into the openings 42, defining the full structure.

As described to this juncture, the travel crib has the generally rectangular bottom and upstanding walls shape which has been detailed hereinabove. Several other details are important and worth noting as shown in FIG. 3 of the drawings, where the numeral 52 identifies a U-shaped reinforcing bead. Preferably, four are used having equal lengths so that two cover each side. Two are placed end-to-end along the sidewalls as shown in FIG. 3. Needless to say, a symmetrical arrangement is formed on the opposite sidewall. The beads serve as stiffening members. Collectively, they stiffen the sidewalls and make them more rigid. The end walls are double and, in some places, triple folds of material and have suitable strength.

The two forms of the travel crib disclosed so far comprise the flat sheet form of FIG. 4 and the assembled form shown in FIG. 3. It can take another shape. Briefly, the travel crib includes the machine formed fold lines at 28 which enables the sidewalls to be folded over against the bottom. As they folded over, it pulls the end walls down flat against the bottom. At this juncture, folds have been accomplished along the diagonal fold lines 28. Moreover, the fold line 54 shown in FIG. 3 is adjacent to and parallel to the fold line 24 in FIG. 3. This, therefore, enables the entire box assembly to be folded flat and to have a relatively thin form. A subsequent fold is made along the lines 54 and 24. The apparatus is folded over itself so that the bottom portions 20 and 22 are positioned against one another back-to-back. This reduces the length of the folded equipment in half. Needless to say, the stiffeners 52 are removed prior to folding along the line 24.

Figure 5:
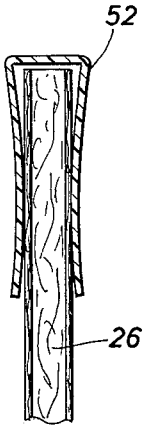
FIG. 5 shows an edge-mounted reinforcing strip.

FIG. 5 shows a stiffening member 52 affixed to the upstanding wall 26. It will be observed that it has a clamping action resulting from the inwardly directed curvature of the two legs. It holds frictionally against the box sidewall.

The travel crib is carried in the container shown in FIG. 1 and can be removed by hand operation. Once laid on an open surface, it has the form shown in FIG. 2. It is then folded to a usable condition by positioning the two bottom portions parallel to one another in a common plane and raising the end walls. As they are raised, they pull the sidewalls to an upright position where they unfold along the creases 28. The next step in the assembly of the travel crib is to place the reinforcing bars 52 along the edges at all four locations. When that is complete, the apparatus is then ready to use. Subsequently, it is refolded by reversing the sequence of assembly steps.

The dimensions can be varied in a relative manner. For instance, the bottom is typically in the range of forty to eighty centimeters in width and has a length between one and two times the width. These dimensions, however, are only typical, certainly not limiting. The sidewalls should extend at least fifteen and typically up to twenty-five centimeters in height. Again, these dimensions are typical and can be varied over a wide range.

Preferably, the apparatus is made of 275 pound test cardboard stock. Needless to say, other weights and types of sheet material can be used. Single wall corrugated material is ordinarily the most desirable material.

While the foregoing is directed to the preferred embodiment, the scope of the present invention is determined by the claims which follow.

I claim:

1. A travel crib suitable for holding an infant comprising:

(a) a sheet of corrugated paperboard of a selected gauge of thickness, the sheet folding into a generally rectangular, open topped crib;

(b) a bottom portion in said sheet which is adapted to be rested on a bottom support therefor and to hold an infant thereon;

(c) an attached sidewall portion which is defined by a fold line adjacent to said bottom portion and which sidewall portion is erected on folding perpendicular to said bottom portion;

(d) an end portion which is defined by a fold line adjacent to said bottom portion and which end portion is erected on folding perpendicular to said bottom portion and is also erected perpendicular to said sidewall portion;

(e) a flap attached to one of said end wall or sidewall portions at a fold line, said fold line enabling said flap to be folded at an angle and which flap is attached to one of said end wall or sidewall portions at a location enabling said flap to be positioned adjacent to and parallel to the other of said sidewall or end wall portions;

(f) pocket means for defining a pocket to catch and enclose said flap for holding said flap therein after assembly;

(g) said flap and said pocket means forming a perpendicular joinder between said sidewall and end wall portions to define walls upright and above said bottom portion;

(h) a transverse, central fold line across said bottom portion;

(i) an extended fold line across said sidewall portions aligned with and extending from said transverse, central fold line;

(j) a pair of angled fold lines across either of said sidewall or end wall portions which angled fold lines extend from the corners defined by said bottom portion, sidewall portion and end wall portions such that said pair of fold lines enable folding therealong to reposition that portion of said sheet between said fold lines to be folded toward and parallel to said bottom portion which movement is coupled to the other of said end wall or sidewall portions which is pulled toward a parallel position;

(k) wherein said transverse and extended fold lines are parallel to one another and adjacent to one another to enable said bottom portion and said sidewall portions to be folded therealong through 180° to position said bottom portion in two parts adjacent to one another wherein said bottom portion parts are on opposite sides of said extended fold line; and (l) wherein said sidewall and end wall portions are deployed parallel to one another and are subsequently erected above said bottom portion on erection of said travel crib.

2. The apparatus of claim 1 including detachable sidewall portion stiffeners joinable to said sidewall portions.

3. The apparatus of claim 1 including a hollow, rectangular carrying case having an internal cavity sized to receive said travel crib therein when it is folded into a nonerected shape.

4. The apparatus of claim 3 including a rectangular, hollow cavity sized to receive and hold said bottom portion.

5. The apparatus of claim 4 including a handle affixed to said carrying case.

6. The apparatus of claim 1 wherein said end wall portion includes (a) a first end wall portion having a height equal to that of a sidewall portion;

(b) a second and adjacent end wall portion;

(c) a double fold line between said first and second end wall portions spaced such that folding therealong positions said first and second end wall portions parallel to form said pocket means;

(d) tab means on said second end wall portion; and (e) slots formed in said sheet at a location to receive said tab means therein for securing said pocket means at a specified location and position for engagement by said flap.

7. The apparatus of claim 6 including a pair of symmetrical tab means and symmetrical slots.

* * * * *